US012471640B1

(12) United States Patent
Norris

(10) Patent No.: US 12,471,640 B1
(45) Date of Patent: Nov. 18, 2025

(54) BRASSIERE WITH MODIFIABLE CUP CONFIGURATIONS

(71) Applicant: Merria R. Norris, Weirsdale, FL (US)

(72) Inventor: Merria R. Norris, Weirsdale, FL (US)

( * ) Notice: Subject to any disclaimer, the term of this patent is extended or adjusted under 35 U.S.C. 154(b) by 0 days.

(21) Appl. No.: 19/176,607

(22) Filed: Apr. 11, 2025

(51) Int. Cl.
*A41C 3/00* (2006.01)
*A41C 3/14* (2006.01)

(52) U.S. Cl.
CPC ..... *A41C 3/0028* (2013.01); *A41C 3/146* (2013.01)

(58) Field of Classification Search
CPC ..... A41C 3/0028; A41C 3/146
See application file for complete search history.

(56) References Cited

U.S. PATENT DOCUMENTS 2,516,129 A * 7/1950 Leo ..... A41C 3/105 623/7
2,597,924 A * 5/1952 Davenport ..... F16K 15/202 251/303
2,725,633 A * 12/1955 Graf ..... A61B 5/107 33/2 R
2,741,769 A * 4/1956 White ..... A41C 3/105 450/38
2,842,775 A * 7/1958 Pangman ..... A61F 2/12 450/38
4,024,856 A * 5/1977 Kirianoff ..... A61B 5/4312 623/7
4,263,682 A * 4/1981 Bejarano ..... A61F 2/12 473/610
5,347,656 A * 9/1994 Fabritz ..... A41C 3/105 450/38
5,823,852 A * 10/1998 Chu ..... A41C 3/105 137/844
6,132,288 A * 10/2000 Aerts ..... A41C 3/144 623/7
6,302,760 B1 * 10/2001 Dai ..... A41C 3/105 450/38
6,796,875 B1 * 9/2004 Placik ..... A61F 2/12 450/38
7,001,240 B1 2/2006 Huffman-Jimenez
7,118,444 B2 10/2006 Newman
7,695,343 B2 4/2010 Nobbs
7,879,091 B1 * 2/2011 Martin ..... A61F 2/52 450/55
8,708,773 B2 4/2014 Afxentiou
9,408,420 B2 8/2016 Betts
9,427,310 B2 * 8/2016 Sjunnesson ..... A61F 2/12
(Continued)

*Primary Examiner* — Gloria M Hale
(74) *Attorney, Agent, or Firm* — Cramer Patent & Design, PLLC.; Aaron R. Cramer

(57) ABSTRACT

A brassiere with modifiable cup configurations provides adjustable breast support to accommodate varying breast sizes or asymmetry. Each cup includes an inner layer and an outer layer defining an interstitial space. Within each interstitial space, a breast cup expandable bag is positioned, capable of receiving and retaining gel injected through an insert port connected via a one-way valve. The breast cup expandable bag is supported by an expandable round elastic equipped with movable structures comprising roller wheels, guided along a movable track and track guard to enable precise shaping. Principal uses include customizing breast support and appearance, particularly beneficial for users with unevenly sized breasts due to medical conditions or natural variation.

10 Claims, 4 Drawing Sheets

(56) References Cited

U.S. PATENT DOCUMENTS

| | | | | |
|---|---|---|---|---|
| 9,788,578 | B2 | 10/2017 | Betts | |
| 9,943,119 | B2 | 4/2018 | Solotoff | |
| 9,961,946 | B2 | 5/2018 | Calhoun | |
| 10,334,890 | B2 | 7/2019 | Sobah | |
| 10,986,881 | B2 * | 4/2021 | Stanton ..... | A41C 3/0064 |

* cited by examiner

BRASSIERE WITH MODIFIABLE CUP CONFIGURATIONS

RELATED APPLICATIONS

None.

FIELD OF THE DEVICE

The present device relates generally to undergarments, and more specifically, to a brassiere designed with modifiable cup configurations for adjustable breast support and symmetry.

BACKGROUND OF THE DEVICE

Conventional brassieres typically offer limited adaptability, often failing to accommodate individuals with uneven breast sizes resulting from medical conditions such as mastectomy, congenital conditions, or natural anatomical variations. Consequently, wearers may experience discomfort, compromised aesthetics, and diminished confidence due to inadequate or improper support. Therefore, a need exists for a brassiere with adjustable and customizable cup configurations capable of providing tailored comfort, improved appearance, and increased confidence for individuals experiencing breast asymmetry.

SUMMARY OF THE DEVICE

The present device is a brassiere designed with modifiable cup configurations that allow users to selectively adjust cup size and shape for customized comfort and improved aesthetics. Various embodiments include an inner and outer fabric layer forming an interstitial space, housing an expandable breast cup bag capable of being inflated through a gel-filled injection via an insert port controlled by a one-way valve. Embodiments also include structural enhancements, such as an expandable round elastic paired with movable roller structures guided along movable tracks and track guards, ensuring precise shaping and stable support. Further embodiments feature bones within supportive wings and adjustable straps with clips, enhancing structural integrity and user comfort. This brassiere is particularly suited for accommodating asymmetrical breasts due to natural differences or medical conditions.

BRIEF DESCRIPTION OF THE DRAWINGS

The advantages and features of the present device will become better understood with reference to the following more detailed description and claims taken in conjunction with the accompanying drawings, in which like elements are identified with like symbols, and in which:

DESCRIPTIVE KEY

Figure 1:
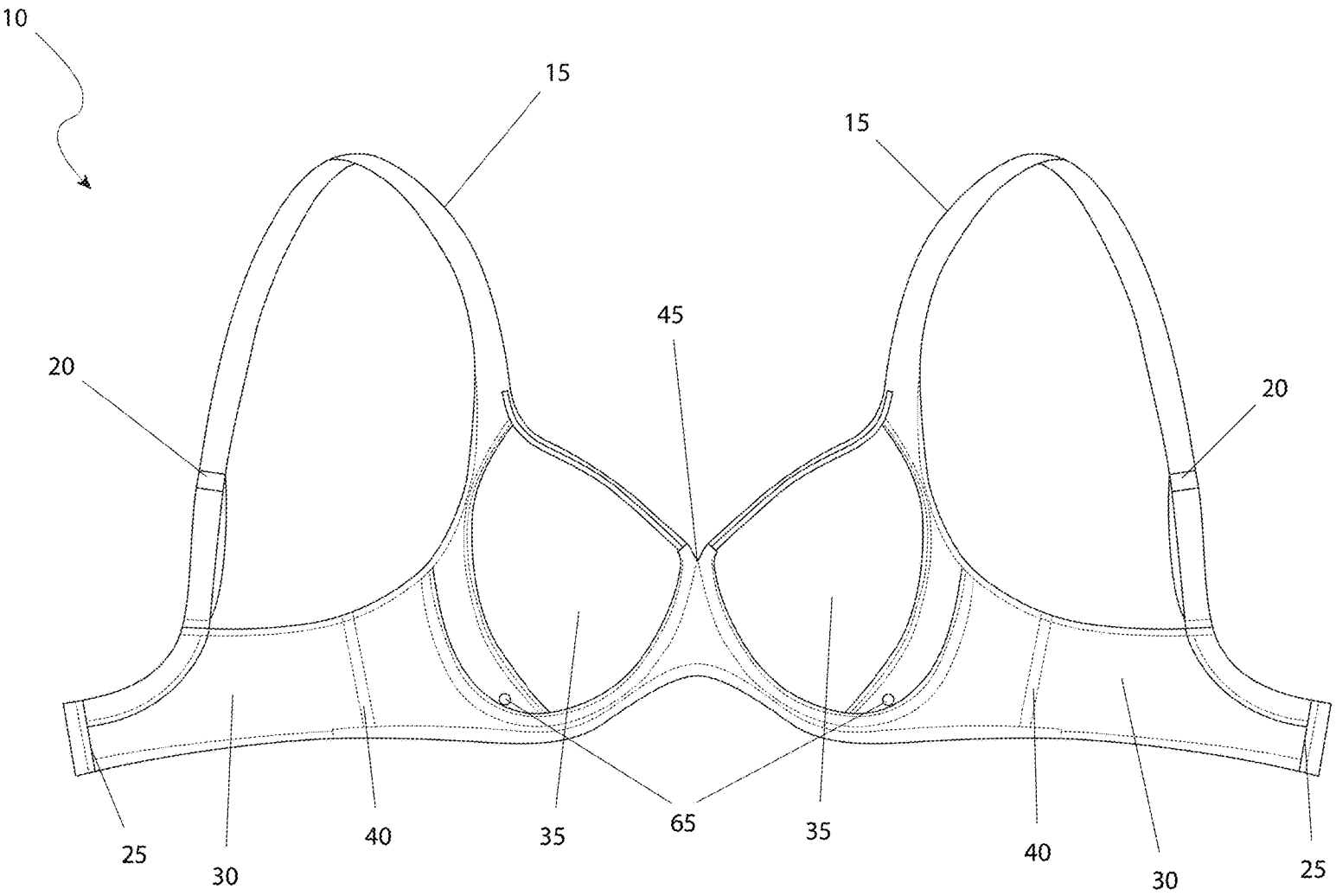
FIG. 1 is a front view of a brassiere with modifiable cup configurations 10, according to the preferred embodiment of the present device.

5 user
6 syringe
10 brassiere with modifiable cup configurations
15 strap
20 adjustable clip
25 hook
30 wing
35 cup
40 bone
45 center gore
50 one-way valve
65 insert port
67 track guard
68 movable track
69 padding
70 gel
80 breast cup expandable bag
90 expandable round elastic
95 roller wheel
100 movable structure
105 retractable travel path "a"
130 seamed area
135 cup inner layer
140 cup outer layer
145 interstitial space Description of the Device The best mode for carrying out the device is presented in terms of its preferred embodiment, herein depicted within FIGS. 1 through 4. However, the device is not limited to the described embodiment, and a person skilled in the art will appreciate that many other embodiments of the device are possible without deviating from the basic concept of the device and that any such work around will also fall under scope of this device. It is envisioned that other styles and configurations of the present device can be easily incorporated into the teachings of the present device, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a front view of a brassiere with modifiable cup configurations 10, according to the preferred embodiment of the present device is disclosed. The brassiere with modifiable cup configurations (herein described as the "brassiere") 10 provides to a user 5 the ability to selectively modify each individual cup 35 thereof. This can be particularly suited for a user 5 who has different-sized breasts and desires to provide an outward appearance of symmetrical breasts. The brassiere 10 includes various components including but not limited to: a pair of straps 15, adjustable clips 20 each associated with an individual strap 15, a plurality of hooks 25 located on wings 30 to attached the brassiere 10 about the body of a user 5, a pair of cups 35, a pair of bones 40, each located within an individual wing 30, and a center gore 45. The brassiere 10 would be made available in multiple sizes, colors, and styles to suit the tastes of the user 5. A cup inner layer 135 and a cup outer layer 140 of each cup 35 of the brassiere 10 would be manufactured from conventional textiles including but not limited to: cotton, rayon, silk, spandex, polyester, and lace. Similar material may be appreciated as usable with the wings 30 and the straps 15. A pair of insert ports 65 are each in fluid communication with a breast cup expandable bag 80 of each cup 35, each controlled with a one-way valve 50.

Figure 4:
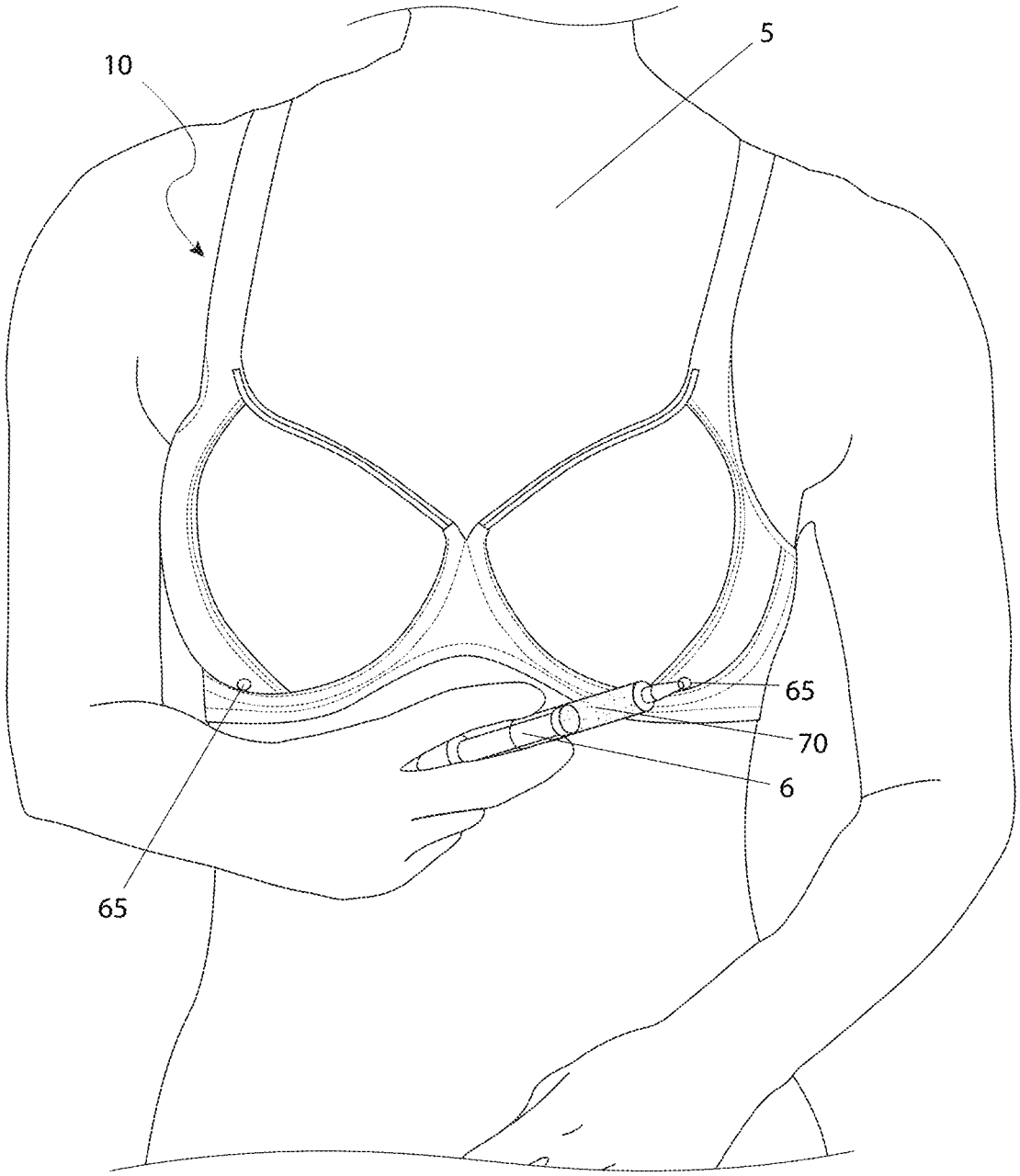

Referring now to FIG. 4, it can be seen that a user 5 is wearing the brassiere 10 and holding a syringe 6. The syringe 6 can be filled with a gel 70 that will not break down with time or use but maintains its structure in form during movement. The syringe 6 has a plunger mechanism capable of forcing an amount of gel 70 through a tip of the syringe 6 and into the environment. As illustrated, the brassiere 10 has an insert port 65 located on each cup 35. The insert port 65 is configured to receive the tip of the syringe 6 such that any injection of gel 70 from the syringe 6 is wholly dispensed within the brassiere 10 when the tip of the syringe 6 is inserted fully within the insert port 65.

Figure 2:
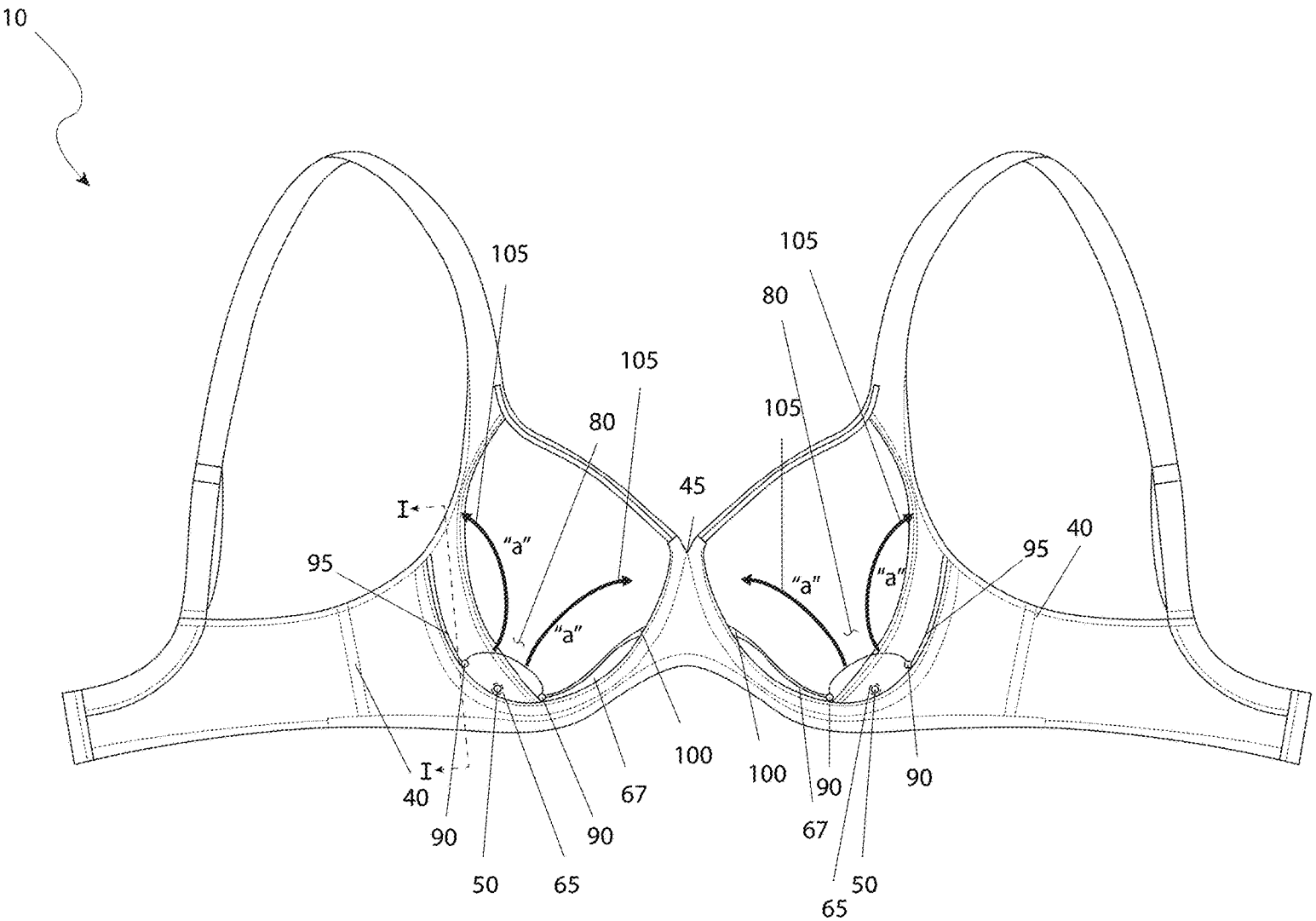
FIG. 2 is an interior view of the brassiere with modifiable cup configurations 10; depicting internal components, according to the preferred embodiment of the present device.

Referring next to FIG. 2, an interior view of the brassiere 10 depicting internal components, according to the preferred embodiment of the present device is depicted. The insert port 65 is in fluid communication with the breast cup expandable bag 80 via the one-way valve 50. The breast cup expandable bag 80 is restrained by an expandable round elastic 90. The expandable round elastic 90 is provided with movable structures 100, such as a roller wheel 95, on each distal end that rides along a track guard 67 and movable track 68, which may be a wire or a plastic form. This allows conforming of the breast cup expandable bag 80 along a retractable travel path "a" 105. It is noted that all of previously described components of FIG. 2 are duplicated on each side of the brassiere 10.

Figure 3:
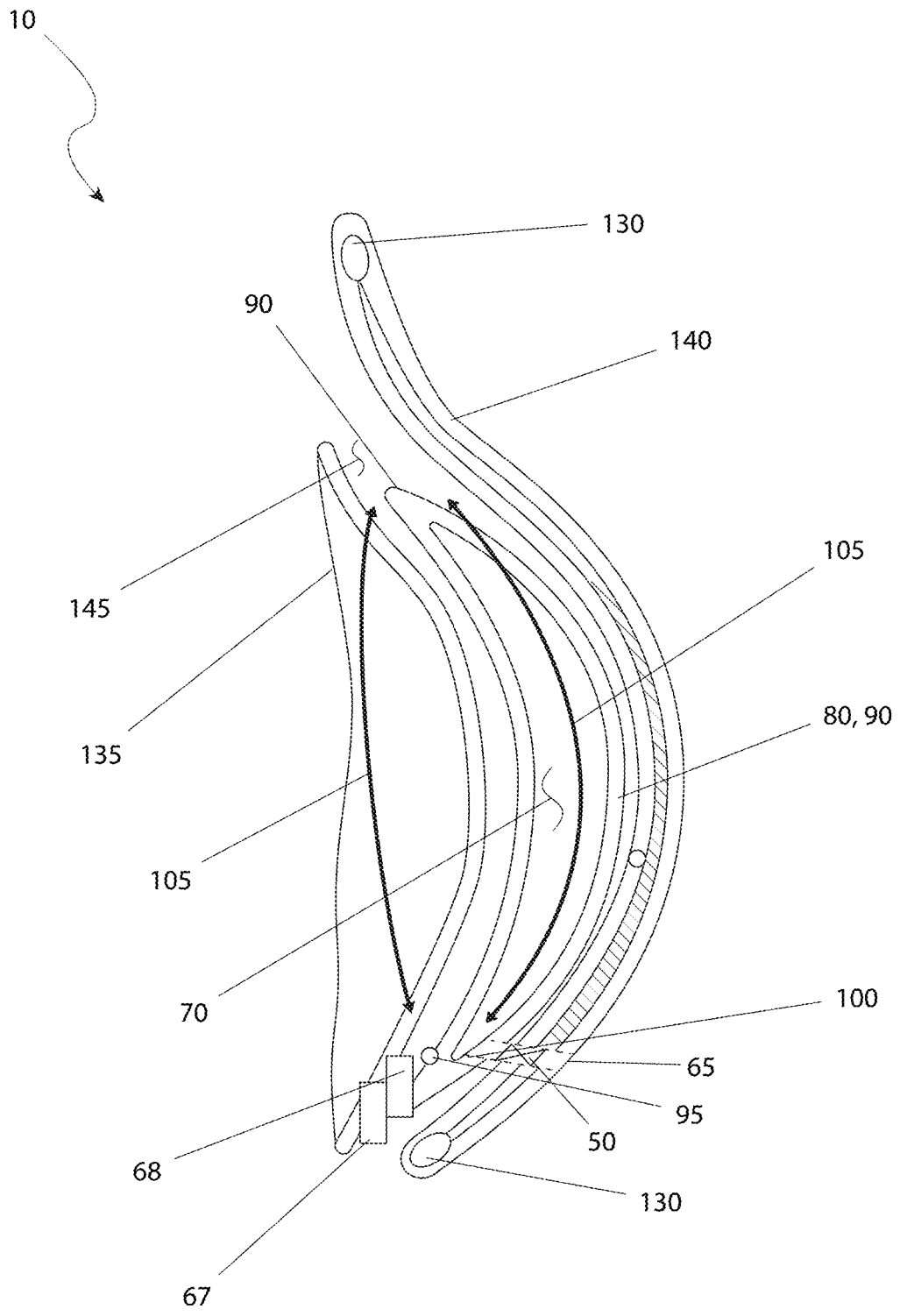
FIG. 3 is a sectional view of the brassiere with modifiable cup configurations 10, as seen along a line I-I, as shown in FIG. 2, according to the preferred embodiment of the present device; and, FIG. 4 is an environmental view of a user 5 injecting an amount of gel 70 from a syringe 6 into an insert port 65 of the brassiere with modifiable cup configurations 10, according to an exemplary method of use of the invention.

Referring next to FIG. 3, a sectional view of the brassiere 10, as seen along a line I-I, as shown in FIG. 2, according to the preferred embodiment of the present device is disclosed. In a manner similar to FIG. 3, a cup inner fabric layer 135 and a cup outer fabric layer 140 are joined by a seamed area 130. The interstitial space 145 may be filled by the breast cup expandable bag 80 as it moves along the retractable travel path "a" 105, in a three-dimensional (3D) manner in reference to FIG. 2 when gel 70 is introduced thereto. A one-way valve 50 is in fluid communication between the expandable round elastic 90 and the insert port 65, and controls one-way flow of gel 70 from the insert port 65 to the breast cup expandable bag 80. Air pressure within the breast cup expandable bag 80 biases the one-way valve 50 closed. This ensures that the breast cup expandable bag 80, once filled with a desired amount of gel 70, can remain filled without leakage. Removal of gel 70 from the breast cup expandable bag 80, when necessary or desired, may occur with manual releasing of the one-way valve 50.

The gel 70 inside may form the shape of the wearer's body along the cup inner fabric layer 135 while produces an aesthetically pleasing breast appearance on the cup outer fabric layer 140. The expandable round elastic 90 is visible in this view, as well as the movable structure 100 as it forms a stable perimeter for the filled breast cup expandable bag 80, whether not filled, minimally filled, partially filled, or maximally filled. The movable structures 100 are preferably roller wheels 95 on either side of the expandable round plastic 90 so as to allow it to push up against the track guards 67 as the gel 70 flows thereinto.

Located on the expandable round elastic 90 is the breast cup expandable bag 80 into which the gel 70 will flow. The breast cup expandable bag 80 is provided with an expandable round elastic 90 at the same location and is attached to the back side thereof. The rear surface of the breast cup expandable bag 80 is of a structured material such that the gel 70 will flow upwards and outwards. The track guard 67 and the movable track 68 are located on the left and right side of the roller wheel 95 respectively. The roller wheel 95 traverses along the track guard 67 located atop the movable track 68. The movable track 68 in turn pulls and/or pushes the respective roller wheel 95. The expandable round elastic 90 is physically attached to the roller wheels 95. It is noted that there is no gel 70 in the breast cup expandable bag 80 until gel 70 is inserted into the breast cup expandable bag 80 through the insert port 65 and the one-way valve 50.

In an additional embodiment, the brassiere with modifiable cup configurations 10 includes all of the previously enumerated structural components working synergistically. Each cup 35 incorporates a cup inner layer 135 and cup outer layer 140, forming an interstitial space 145 containing a breast cup expandable bag 80. This expandable bag 80 is secured and guided along a retractable travel path "a" 105 defined by an expandable round elastic 90, track guards 67, movable tracks 68, and movable structures 100 embodied as roller wheels 95. The insert ports 65, positioned strategically on each cup 35, enable a user 5 to introduce gel 70 via syringe 6 through a one-way valve 50 directly into the breast cup expandable bag 80, inflating the cups 35 selectively to achieve symmetrical aesthetic results. Stability and structural integrity are reinforced through the placement of bones 40 within each wing 30, adjustable clips 20 on straps 15, and a secure closure system comprising multiple hooks 25 on the wings 30 and a center gore 45, ensuring consistent fit and comfort during wear. Padding 69 further enhances comfort by buffering direct contact between internal components and the user's body. This embodiment thus leverages all enumerated elements, offering comprehensive customization and comfort to address a broad spectrum of user-specific fitting needs.

2. Operation of the Preferred Embodiment

The preferred embodiment of the present device can be utilized by the common user 5 in a simple and effortless manner with little or no training. It is envisioned that the brassiere 10 would be constructed in general accordance with FIG. 1 through FIG. 4. The user 5 would procure the brassiere 10 from conventional procurement channels such as clothing stores, department stores, discount stores, specialty clothing stores, mail order and internet supply houses and the like. Special attention would be paid to the overall style, size and color of the brassiere 10, in much the same manner as conventional brassieres are procured. The user 5, envisioned particularly suited for those with un-equal breast sizes such as due to a mastectomy, birth defect, genetic trait, or the like, would be able to adjust the cup 35 over the smaller breast then match the overall size and appearance of the cup 35 over the larger breast. The user 5 would select the size of the brassiere 10 where the cups 35 are based upon the larger of the two (2) breasts.

After procurement and prior to utilization, the user 5 would place their breasts into the cups 35 and introduce a flow of gel 70 from the syringe 6, through the insert port 65, through the one-way valve 50, and into the breast cup expandable bag 80 which is attached to the expandable round elastic 90. The gel 70 is continuously inserted into the breast cup expandable bag 80 until a desired amount is reached. The introduction of gel 70 into one (1) of the cups 35 of the brassiere 10 fills in the gap difference of the breasts of the user 5, if unevenly sized and/or shaped, thus giving the illusion they are equal in size.

During use of the brassiere 10, normal usage patterns, identical to that of a conventional brassiere would be followed. It is envisioned that the brassiere 10 could be used with all types of outer clothing. When finished with use, the brassiere 10 would be removed. Should cleaning be required, the brassiere 10 must be washed only by hand and air dried.

The foregoing descriptions of specific embodiments of the present device have been presented for purposes of illustration and description. They are not intended to be exhaustive or to limit the device to the precise forms disclosed, and obviously many modifications and variations are possible in light of the above teaching. The embodiments were chosen and described in order to best explain the principles of the device and its practical application, to thereby enable others skilled in the art to best utilize the device and various embodiments with various modifications as are suited to the particular use contemplated.

What is claimed is:

1. A brassiere with modifiable cup configurations, comprising:

a pair of cups each having a cup inner layer, a cup outer layer, and an interstitial space defined therebetween;

a breast cup expandable bag positioned within each interstitial space; an insert port in fluid communication with each breast cup expandable bag;

a one-way valve positioned between each insert port and each breast cup expandable bag, configured to control fluid flow into each breast cup expandable bag;

an expandable round elastic coupled to each breast cup expandable bag;

a track guard and a movable track positioned adjacent to each breast cup expandable bag; and, a movable structure comprising roller wheels attached to each expandable round elastic, configured to traverse along each movable track and track guard, enabling movement of each breast cup expandable bag.

2. The brassiere of claim 1, further comprising padding positioned adjacent to each cup inner layer.

3. The brassiere of claim 1, further comprising a pair of wings each containing at least one bone structure configured to reinforce the brassiere during use.

4. The brassiere of claim 1, wherein each insert port is configured to sealingly receive a syringe tip to introduce gel into each breast cup expandable bag.

5. The brassiere of claim 1, wherein each cup inner layer and cup outer layer are joined at a seamed area along peripheral edges.

6. The brassiere of claim 1, further comprising straps coupled to each cup and adjustable clips coupled to each strap.

7. The brassiere of claim 1, wherein the expandable round elastic and movable structure cooperate to guide each breast cup expandable bag along a retractable travel path, enabling selective shaping of each cup.

8. The brassiere of claim 1, wherein the movable track and track guard are fabricated from plastic or wire.

9. The brassiere of claim 1, wherein the gel maintains structural integrity and does not degrade over time.

10. The brassiere of claim 1, wherein the breast cup expandable bag is structured to distribute gel upwardly and outwardly within the interstitial space.

* * * * *